US006516951B2

(12) United States Patent
Sears et al.

(10) Patent No.: US 6,516,951 B2
(45) Date of Patent: Feb. 11, 2003

(54) DISPLAY CONTAINER FOR INDIVIDUAL FOOD SERVINGS

(75) Inventors: Kenneth A. Sears, Cobourg (CA); Paul T. Collier, Whitby (CA)

(73) Assignee: Kraft Canada Inc. (CA)

( * ) Notice: Subject to any disclaimer, the term of this patent is extended or adjusted under 35 U.S.C. 154(b) by 0 days.

(21) Appl. No.: 09/873,315

(22) Filed: Jun. 5, 2001

(65) Prior Publication Data

US 2002/0179483 A1 Dec. 5, 2002

(51) Int. Cl.[7] ..... A45C 11/20
(52) U.S. Cl. ..... 206/541; 206/542; 229/401
(58) Field of Search ..... 206/553, 541, 206/542; 229/401

(56) References Cited

U.S. PATENT DOCUMENTS

| | | | | | |
|---|---|---|---|---|---|
| 1,963,299 | A | * | 6/1934 | Fear | |
| 3,381,876 | A | * | 5/1968 | Biggins | |
| 3,861,579 | A | | 1/1975 | Manis et al. | 229/23 |
| 3,960,313 | A | | 6/1976 | Sax et al. | 229/41 |
| 4,219,147 | A | | 8/1980 | Kohler | 229/27 |
| 4,313,554 | A | | 2/1982 | Montealegre | 229/28 |
| 4,376,508 | A | | 3/1983 | Gardner et al. | 229/28 |
| 4,377,252 | A | | 3/1983 | Schillinger | 229/28 |
| 4,489,878 | A | | 12/1984 | Mode | 229/27 |
| 4,671,450 | A | | 6/1987 | Lopez | 229/27 |
| 4,946,094 | A | * | 8/1990 | Stang | 2/48 |
| 5,056,709 | A | | 10/1991 | Cargile, Jr. | 229/120 |
| 5,082,115 | A | * | 1/1992 | Hutcheson | 206/545 |
| 5,697,707 | A | * | 12/1997 | Esposito | 206/217 |
| 5,909,840 | A | | 6/1999 | Schultheiss | 229/120 |
| 6,012,630 | A | | 1/2000 | Block | 229/120 |
| 6,257,403 | B1 | * | 7/2001 | Feldmeier | 206/217 |

* cited by examiner

*Primary Examiner*—David T. Fidei
(74) *Attorney, Agent, or Firm*—Larson & Taylor, PLC

(57) ABSTRACT

A display container formed from a one-piece blank and having a base panel and four side panels, wherein a portion of the base panel is folded up to form an internal compartment. A triangular segment of the front panel is folded against the side of the internal compartment to stabilize same. Individual food servings are held by the main part of the container while appropriate utensils are held in the internal compartment.

10 Claims, 6 Drawing Sheets

DISPLAY CONTAINER FOR INDIVIDUAL FOOD SERVINGS

FIELD OF THE INVENTION

The present invention relates to a container, and in particular, to an improved display container for individual food servings having a main interior compartment for the individual food servings themselves and another for utensils to be used in conjunction with the individual food servings.

BACKGROUND OF THE INVENTION

Containers formed from paperboard or corrugated cardboard are generally formed from a single blank of material. The blank generally has a plurality of panels that are folded such that a container may be manufactured in a collapsed, flat configuration and then folded into an erect condition.

One use of such containers is as a display container wherein the container is open for viewing and removal of the contents thereof. If the contents are individual food servings, the disadvantage exists that utensils for consumption of the individual food servings are not readily accessible.

Various containers are known wherein a single blank is formed into a container having partitions for a plurality of food or other products. However, such known containers do not contemplate providing a main compartment for individual food servings which also address the problem of making utensils more accessible for use with individual food servings of the container.

Thus there exists a need for a display container for a plurality of products such as individual food servings, particularly a container that can be formed from a flat blank, which container provides a convenient way to associate utensils with the individual serving.

SUMMARY OF THE INVENTION

The disadvantages of the prior art are overcome by the present invention which comprises a display container with a main compartment for individual food servings and a separate integrally formed compartment for utensils or the like.

Thus, it is an object of the present invention to provide a container for individually packaged food servings which allows the retailer the ability to simply open the top panel to reveal the contained food products for retail sales thereof, while also providing an internal compartment for utensils.

It is also an object of the present invention to provide a container formed from a single blank of material with a base, side and end panels and separate compartments for holding the individual food servings and utensils to be used for consuming the individual food serving.

It is another object of the present invention to provide a container for food products which includes an internal utensil compartment which is formed solely by means of friction, thereby requiring no glue, tape or other securing means.

In accordance with a preferred embodiment of the invention, the internal utensil compartment is formed by means of a groove formed when an interior side panel flap is folded over, and wherein a flap forming the utensil compartment locks into such groove. In addition, a triangular portion of the front panel is folded against the internal utensil compartment to provide additional integrity and support. Therefore, no separate insert is needed to produce this internal compartment.

In accordance with one aspect of the invention, the containers may be individually packaged pudding snacks and the utensils can be plastic spoons.

In a preferred embodiment, the present invention provides a container for food products wherein the main internal compartment contains a plurality of individually packaged individual food servings and the smaller internal compartment contains a sufficient quantity of plastic spoons.

Further features and advantages of the present invention will be set forth in, or apparent from, the detailed description of preferred embodiments thereof which follows.

BRIEF DESCRIPTION OF THE DRAWINGS

The foregoing objects and advantages of the present invention will be more readily understood by reference to the following detailed description of the preferred embodiments and to the accompanying drawings which form part of the disclosure, and wherein.

DESCRIPTION OF THE PREFERRED EMBODIMENTS

Figure 1:
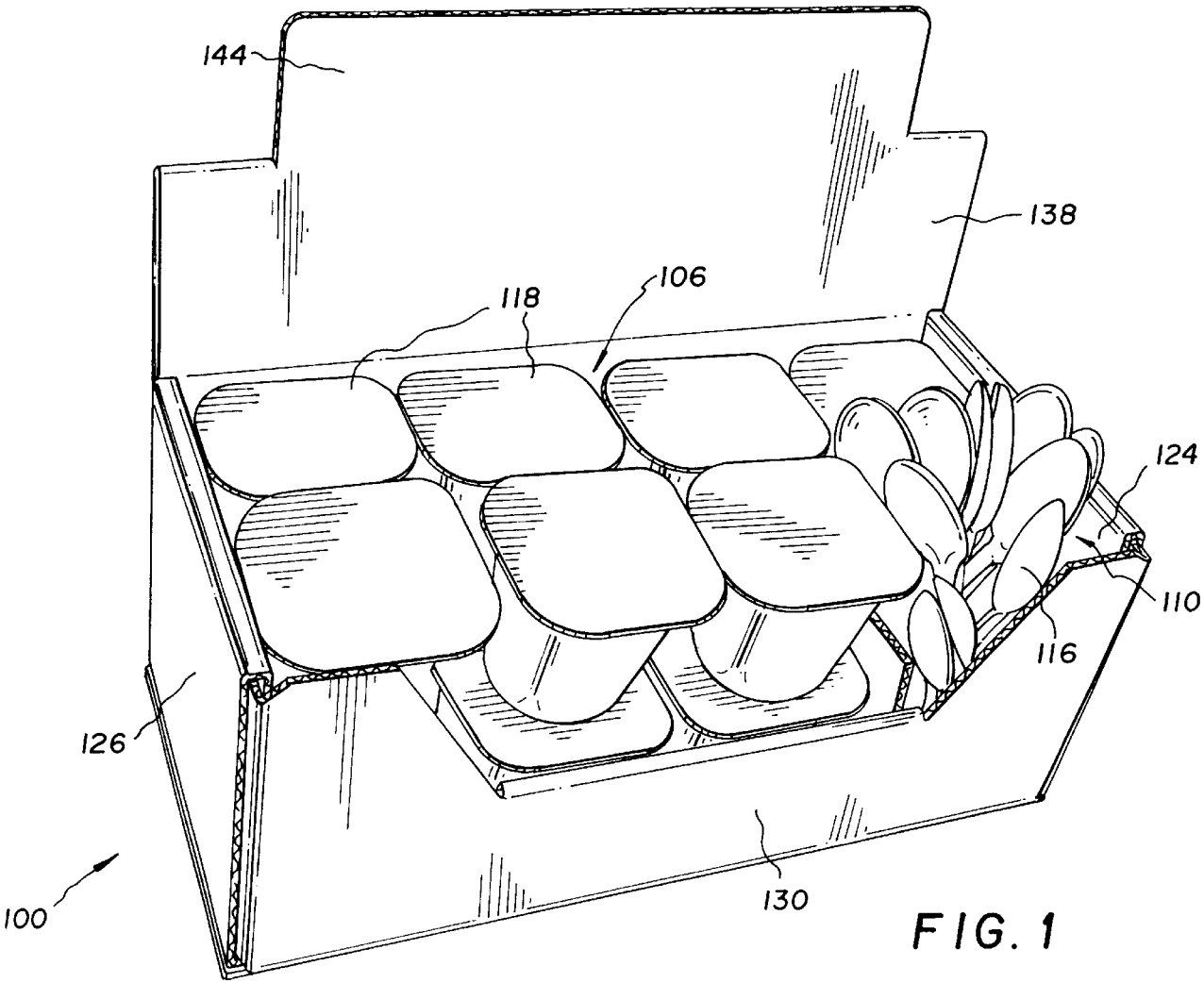
FIG. 1 is a top front perspective view showing a container formed from the blank of FIG. 6, showing individually packaged food servings and utensils.

Referring now to the drawings, like numbers represent like elements throughout the several views. Reference numeral 150 generally identifies a collapsed, container blank in FIG. 6, which is formed as an erect container 100 in FIGS. 1–5.

Referring to FIG. 1, container 100 contains a plurality of individually packaged food products 118 contained in a main internal compartment 106 and a plurality of individual servicing spoons 116 standing upright in a second internal compartment 110.

Figure 2:
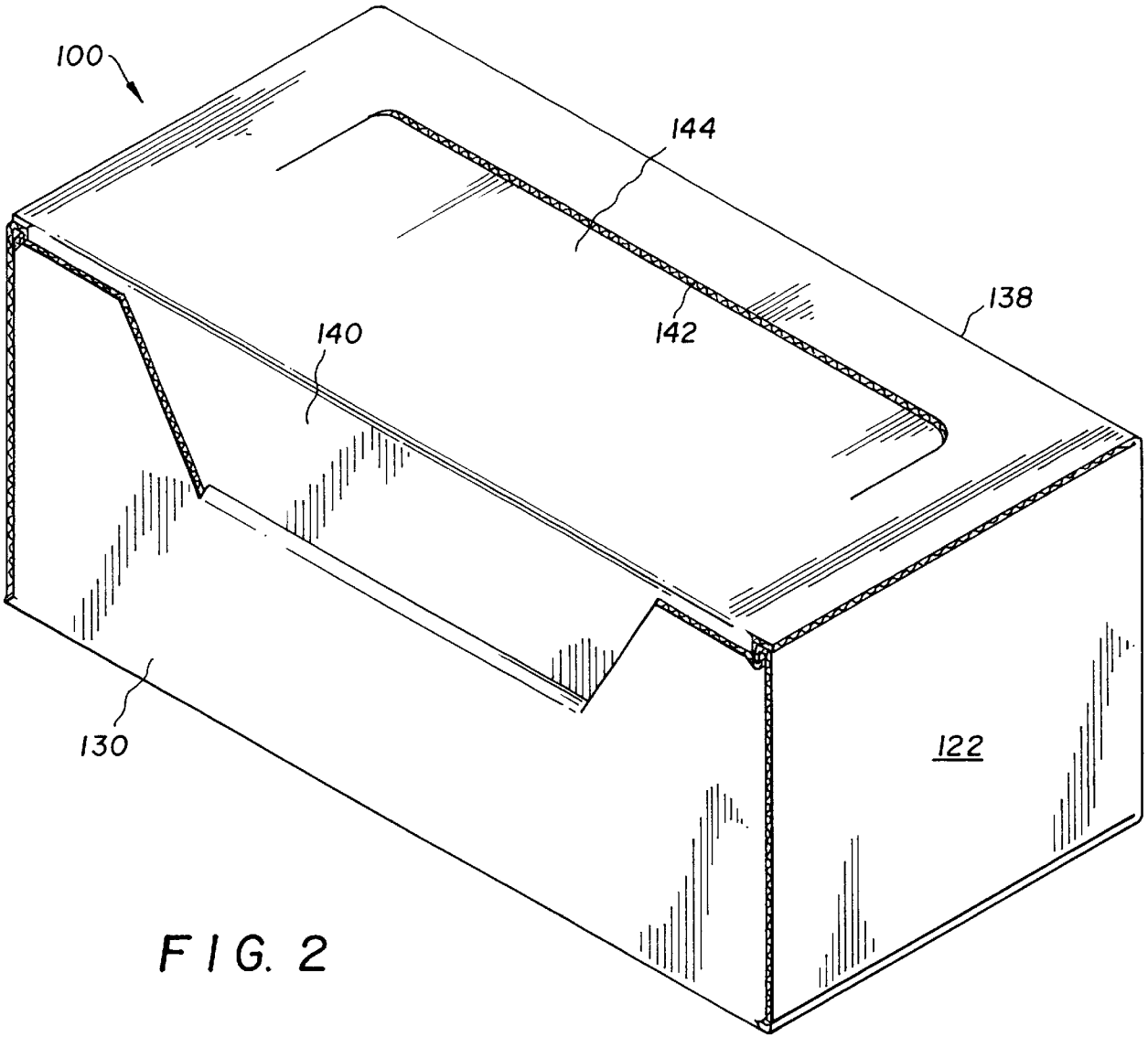
FIG. 2 is a top front perspective view of the container formed from the blank of FIG. 6, in a closed condition.
Figure 3:
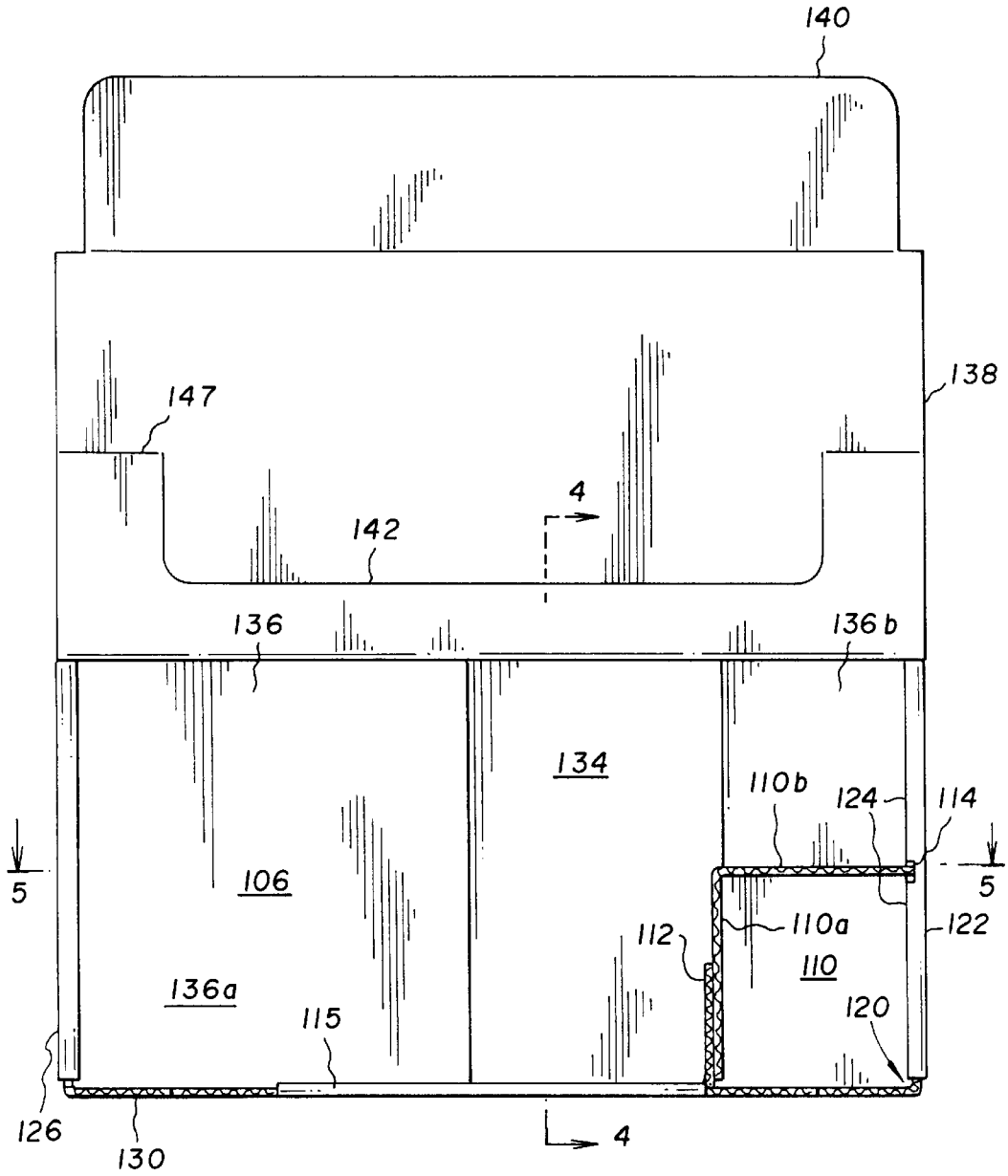
FIG. 3 is a plan view of the container formed from the blank of FIG. 6 with the top opened and folded back.
Figure 4:
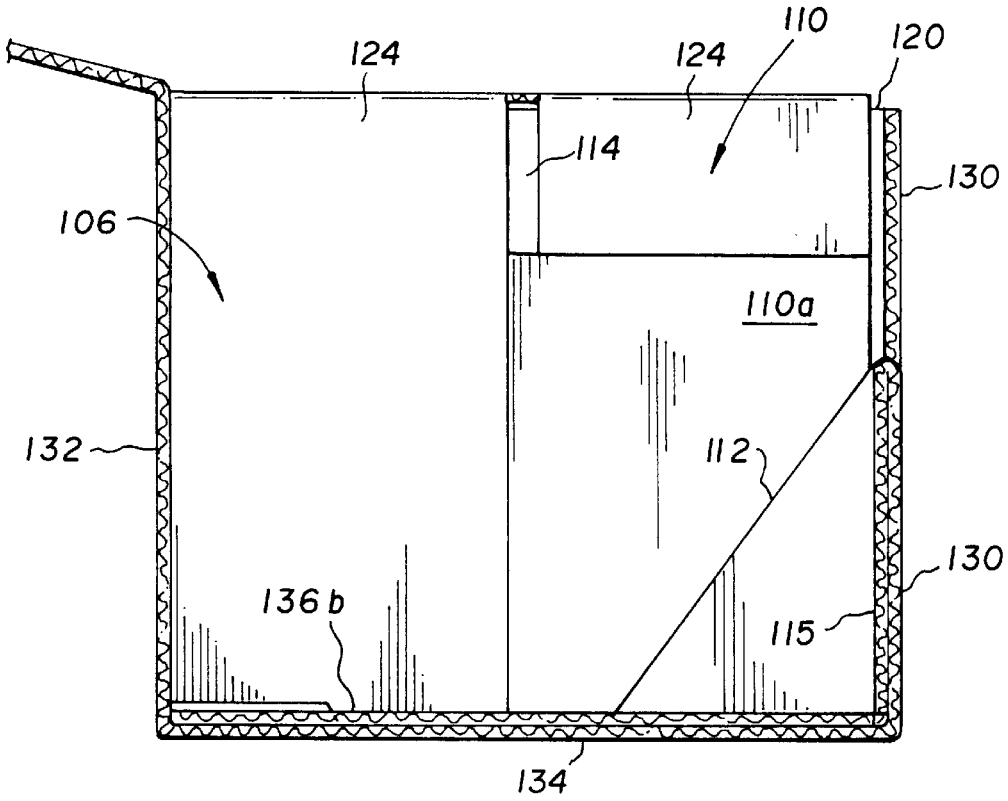
FIG. 4 is an elevational cross-sectional view taken along line 4—4 of FIG. 3.
Figure 5:
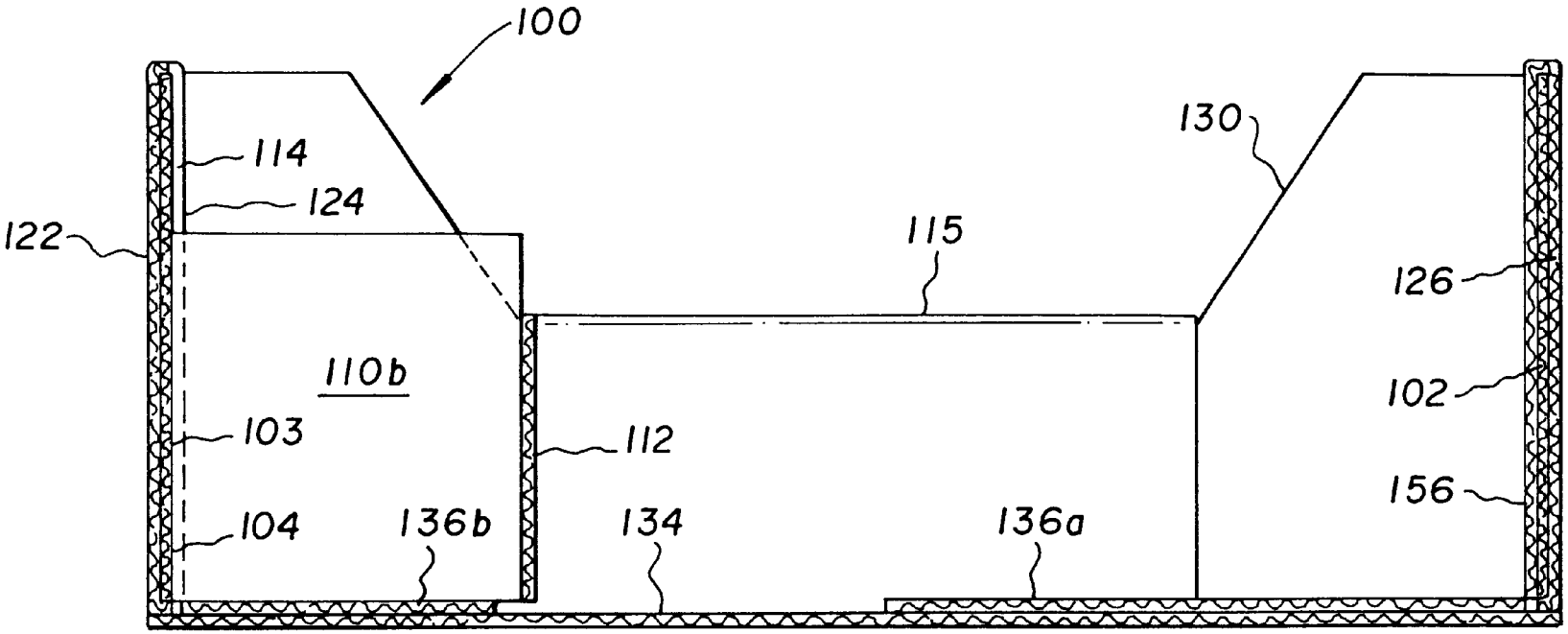
FIG. 5 is an elevational cross-sectional view taken along line 5—5 of FIG. 3.

FIG. 2 shows the compact nature of the container 100 and its ability to entirely encapsulate the contained food products and utensils. The top panel 138 has an enclosure means 140 in the closed position and a slit 142 to form a display panel 144 as shown in FIG. 1.

Figure 6:
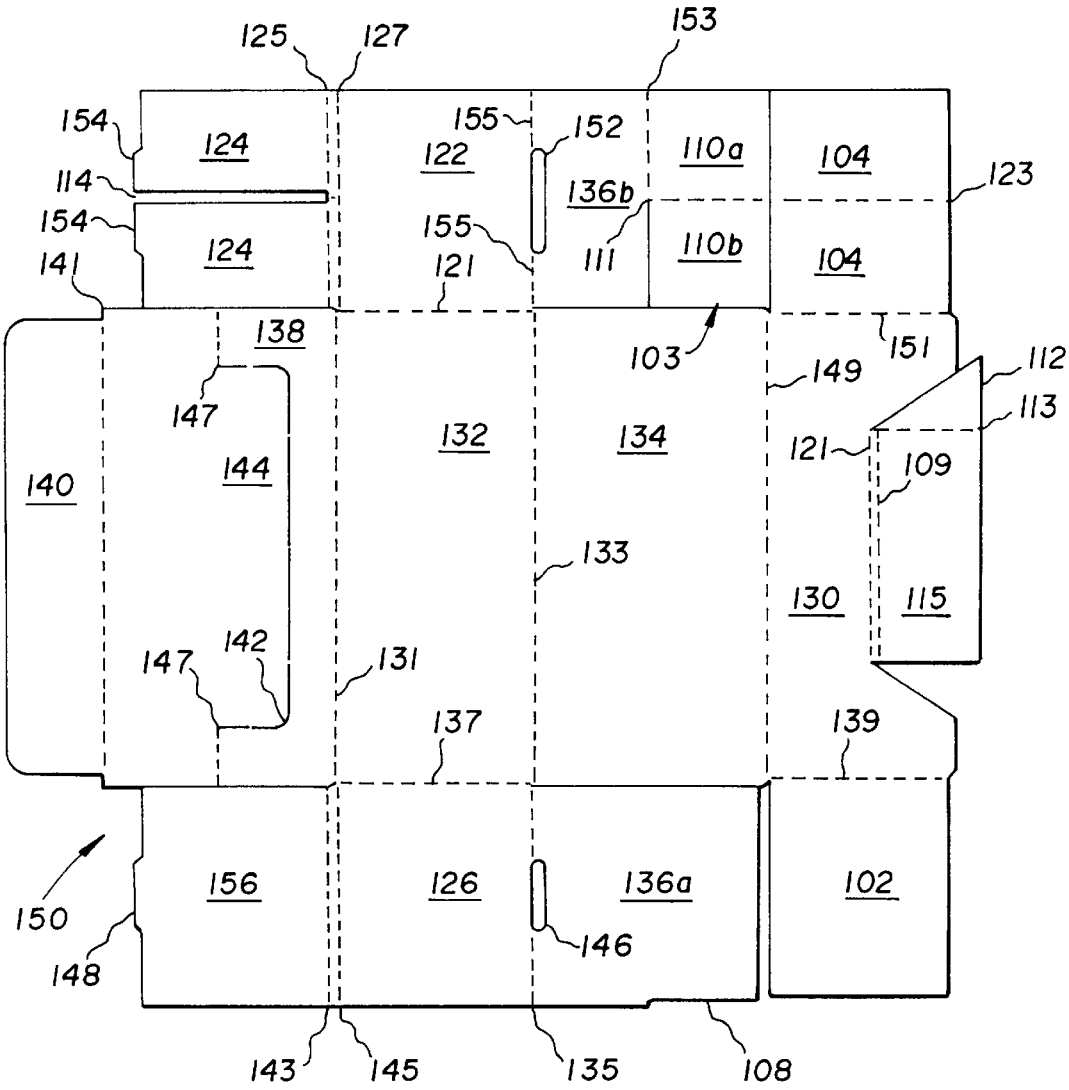
FIG. 6 is a plan view of the blank used to form the container of FIGS. 1–5.

FIG. 6 is a plan view of the one piece blank 150 used to form the erect container 100. To fold the flat blank 150 into the erect container 100, the exterior left side panel 126 is folded upward ninety degrees along fold line 137 while the exterior right side panel 122 is similarly folded up along fold line 121. There are two upper base panels, namely a first base panel 136*a* attached at fold line 135 to side panel 126 and a second base panel formed by panels 136*b*, 110*a* and 110*b* which is connected to side panel 122 at fold line 155. The upper base panel 136 is then folded upward ninety degrees along fold lines 135 until the upper base panel 136 is aligned with fold line 133. Similarly, the upper base panel 136*a*, 110*a* and 110*b* is folded up along line 155 until it is aligned with fold line 133. Back panel 132 is then folded upward ninety degrees along fold line 133 until upper base panels 136*a* and 136*b*, 110*a* and 110*b* lie completely over lower base panel 134. Internal left side panel 102 and internal right side panel 104 are then folded upward ninety degrees along fold lines 139 and 151, respectively. Exterior front panel 130 is then folded ninety degrees upward along fold line 149 until interior left side panel 102 abuts fold line 135 and interior right side panel 104 abuts fold line 155. The interior left side panel 156 is then folded ninety degrees along fold line 143 and again ninety degrees downward along fold line 145 over the top of panel 102 until left panel tab 148 engages tab insertion slot 146. Similarly, interior right side panel 124 is folded ninety degrees downward along fold line 125 and again ninety degrees downward along fold line 127 over the top of panel 104 until right side panel tabs 154 engages tab insertion slot 152, completing the formation of the main internal compartment 106.

Second internal compartment 110 is then formed by folding panels 110*a* and 110*b* ninety degrees upward along fold line 153 and then folding panel 110*b* along fold line 111 until its edge 103 securely locks into groove 114. Triangular stabilizing support 112 is then folded ninety degrees along fold line 113. Interior front panel 115 is then folded ninety degrees inward along fold line 109 and again ninety degrees downward along fold line 121 until interior front panel 115 is lodged between interior front panel groove 108 and the interior of front panel 130. Triangular stabilizing support 112 then abuts the panel 110*b* of second internal compartment 110.

The main internal compartment 106 may be filled with food products 118 and the second internal compartment may be filled with utensils 116. The container 100 can be securely closed by folding the enclosure means 140 ninety degrees downward along fold line 141 and the top panel 138 ninety degrees downward along fold line 131 until enclosure means 140 meets enclosure means groove 120 and negative space 101.

To open the container 100 for retail use, the top panel 138 is lifted from its closed position along fold line 131 revealing the enclosure means 140. The display panel 144 is utilized by folding along fold line 147 until the enclosure means 140 is aligned snugly against the back panel 132.

In accordance with one aspect of the invention, the food products 118 of the main internal compartment 106 are individually packaged pudding snacks and the utensils 116 of the second internal compartment 110 are plastic spoons which may be individually wrapped. Further, the blank 150 of the present invention can be made from, but is not limited to the following materials: cardboard, paperboard or matboard. The dimensions of the present invention are not limited and can vary depending on the number and the size of the contained food products and utensils.

In a preferred embodiment of the present invention, the main internal compartment 106 contains fourteen individually packaged pudding snacks, the second internal compartment 110 contains at least fourteen individually wrapped plastic spoons and the blank 150 is made from corrugated cardboard.

Although the dimensions of the present invention are not limited, in one preferred embodiment the present invention preferably measures 273 millimeters in length, 138 millimeters in width and 114 millimeters in depth.

Although the invention has been described above in relation to preferred embodiments thereof, it will be understood by those skilled in the art that variations and modifications can be effected in these preferred embodiments without departing from the scope and spirit of the invention.

What is claimed is:

1. A container comprising a base panel, a front panel, a back panel, a right side panel, and a left side panel, said panels forming a first internal compartment and wherein a segment of said base panel is folded up to form a second internal compartment and a segment of said front panel is folded against said second internal compartment to stabilize same.

2. The container of claim 1 wherein said container additionally comprises a top panel foldably joined to said back panel on one end and having an opposing end adapted to fit against said front panel, right side panel, and left side panel to close said container.

3. The container of claim 1 wherein said front panel is partially cut away to facilitate consumer accessibility to the contents of said first and second internal compartments.

4. A container for individual food servings comprising a base panel, a front panel, a back panel, a right side panel, and a left side panel, said panels forming a first internal compartment for holding a plurality of individual food servings and a second internal compartment having an open top and adapted to receive a plurality of utensils in an upright orientation, a portion connected to the base panel folded up from the base to form a wall separating the first internal compartment from the second internal compartment, a portion of the front panel folded against said folded up portion of the base panel to engage and stabilize said wall, said container having an open display configuration wherein said individual food servings of the first internal compartment and said utensils of the second internal compartment are freely accessible for use by a consumer.

5. The container of claim 4 wherein said container additionally comprises a top panel foldably joined to said back panel on one end and having an opposing end adapted to fit against said front panel, right side panel, and left side panel to close said container.

6. The container of claim 4 wherein said front panel is partially cut away to facilitate consumer accessibility to the individual food servings of said first internal compartment and utensils of said second internal compartment.

7. The first internal compartment of claim 4 containing fourteen individual food servings and at least fourteen utensils.

8. A display container for displaying individual food servings together with utensils to be used therewith, said container having a base panel, side panels, a back panel and a front panel, which panels define a rectangular space, an internal compartment formed in one corner of the container, a portion connected to the base panel folded up from the base to form the wall of the internal compartment, a portion of the front panel folded against said folded up portion of the base panel to engage and stabilize said wall, and wherein said individual food servings are located in the main part of the container and utensils are located in said internal compartment.

9. A display container according to claim 8, wherein the container is-formed from a one-piece blank.

10. A display container according to claim 8, wherein the individual food servings comprise individual pudding servings and the utensils are spoons.

* * * * *